US010910175B2

(12) United States Patent
Huang et al.

(10) Patent No.: US 10,910,175 B2
(45) Date of Patent: Feb. 2, 2021

(54) KEY STRUCTURE

(71) Applicants: LITE-ON ELECTRONICS (GUANGZHOU) LIMITED, Guangzhou (CN); Lite-On Technology Corporation, Taipei (TW)

(72) Inventors: Kuan-Ming Huang, Taipei (TW); Jen-Chieh Huang, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 16/387,546

(22) Filed: Apr. 18, 2019

(65) Prior Publication Data

US 2020/0066466 A1 Feb. 27, 2020

(30) Foreign Application Priority Data

Aug. 23, 2018 (CN) ..... 2018 2 1365654 U

(51) Int. Cl.
*H01H 13/7065* (2006.01)
*H01H 13/86* (2006.01)

(52) U.S. Cl.
CPC ..... *H01H 13/7065* (2013.01); *H01H 13/86* (2013.01); *H01H 2221/044* (2013.01); *H01H 2227/016* (2013.01); *H01H 2233/07* (2013.01)

(58) Field of Classification Search
CPC ..... H01H 13/7065; H01H 13/86; H01H 2221/044; H01H 2233/07; H01H 2227/016; H01H 3/125; H01H 13/85; H01H 2221/062
USPC ..... 200/341, 344, 345, 5 A
See application file for complete search history.

(56) References Cited

U.S. PATENT DOCUMENTS

| | | | | |
|---|---|---|---|---|
| 9,941,073 | B2 * | 4/2018 | Chen | H01H 13/703 |
| 9,959,990 | B1 * | 5/2018 | Pan | H01H 13/14 |
| 10,373,779 | B2 * | 8/2019 | Liao | H01H 13/88 |
| 10,381,175 | B2 * | 8/2019 | Yang | H01H 1/54 |

* cited by examiner

*Primary Examiner* — Edwin A. Leon
*Assistant Examiner* — Lheiren Mae A Caroc
(74) *Attorney, Agent, or Firm* — JCIPRNET

(57) ABSTRACT

The disclosure provides a key structure, including a carrier, a buffer layer, a circuit film, a balance rod and a key cap. The carrier includes a body and a positioning element protruding from the body. The positioning element has a positioning hole. The buffer layer is disposed around the positioning hole. The circuit film and the balance rod are disposed on the body. The balance rod has an opposite first end portion and a second end portion. The first end portion passes through the positioning hole and presses against the buffer layer. The key cap is connected with the second end portion, and the circuit film and the balance rod are positioned between the key cap and the body.

11 Claims, 7 Drawing Sheets

KEY STRUCTURE

CROSS-REFERENCE TO RELATED APPLICATION

This application claims the priority benefit of China application serial no. 201821365654.4, filed on Aug. 23, 2018. The entirety of the above-mentioned patent application is hereby incorporated by reference herein and made a part of this specification.

BACKGROUND OF THE DISCLOSURE

Field of the Disclosure

The disclosure relates to a key structure, and particularly relates to a key structure applied to a keyboard.

Description of Related Art

As a common physical input device, the keyboard is widely applied to notebook computers and personal desktop computers or may be combined with tablet computers to expand a base. Generally, the keyboard is provided with a plurality of key structures, each key structure includes a key cap, and the key cap has a number of size combinations according to requirements.

For example, the size of the key cap corresponding to a space key in the keyboard is larger; in order to improve the stability during actuation, the key cap is connected with the carrier by adopting a balance rod generally; however, during vertical actuation of the key cap, friction or collision between the balance rod and carrier is caused following actuation of the key cap, and a user feels uncomfortable due to generated noise. Therefore, how to reduce the noise has become one of the problems to be urgently resolved by related manufacturers.

SUMMARY OF THE DISCLOSURE

The disclosure provides a key structure capable of reducing noise generated during actuation.

The key structure of the disclosure includes a carrier, a buffer layer, a circuit film, a balance rod and a key cap. The carrier includes a body and a positioning element protruding from the body. The positioning element has a positioning hole. The buffer layer is arranged around the positioning hole. The circuit film is disposed on the body. The balance rod is disposed on the body. The balance rod has a first end portion and a second end portion which are opposite. The first end portion passes through the positioning hole and presses against the buffer layer. The key cap is connected to the second end portion, and the circuit film and the balance rod are positioned between the key cap and the body.

In an embodiment of the disclosure, the body has a through hole, and the positioning element is arranged in the through hole.

In an embodiment of the disclosure, the positioning element includes a connecting portion, a first extension portion and a second extension portion, and the connecting portion is connected with an inner wall surface of the through hole. The second extension portion is positioned above the through hole and is parallel to the connecting portion. The second extension portion is connected with the connecting portion through the first extension portion, and the positioning hole runs through the connecting portion and the first extension portion.

In an embodiment of the disclosure, the buffer layer is disposed on a side of the second extension portion facing the through hole.

In an embodiment of the disclosure, the buffer layer partially extends into the positioning hole.

In an embodiment of the disclosure, the circuit film is partially located in the positioning hole and presses against the first end portion.

In an embodiment of the disclosure, a side of the key cap facing the body is provided with a pivotal connection portion, and the second end portion passes through the pivotal connection portion.

In an embodiment of the disclosure, the key structure further includes a reciprocating element positioned between the key cap and the body, and two opposite ends of the reciprocating element are respectively connected with the key cap and the body.

In an embodiment of the disclosure, the key structure further includes a dome switch positioned between the key cap and the circuit film, and two opposite ends of the dome switch are respectively connected with the key cap and the circuit film.

Based on the above, since the key structure of the disclosure in the carrier is configured to provide the buffer layer for the installation of balance rod, during actuation of the balance rod relative to the carrier, based on the obstruction of the buffer layer, friction and collision between the balance rod and the carrier cannot be generated, noise generated during actuation of the key structure may be greatly reduced, and the discomfort of a user in the process of operating the keyboard may be avoided.

In order to make the aforementioned and other objectives and advantages of the disclosure comprehensible, embodiments accompanied with figures are described in detail below.

DESCRIPTION OF THE EMBODIMENTS

Figure 1:
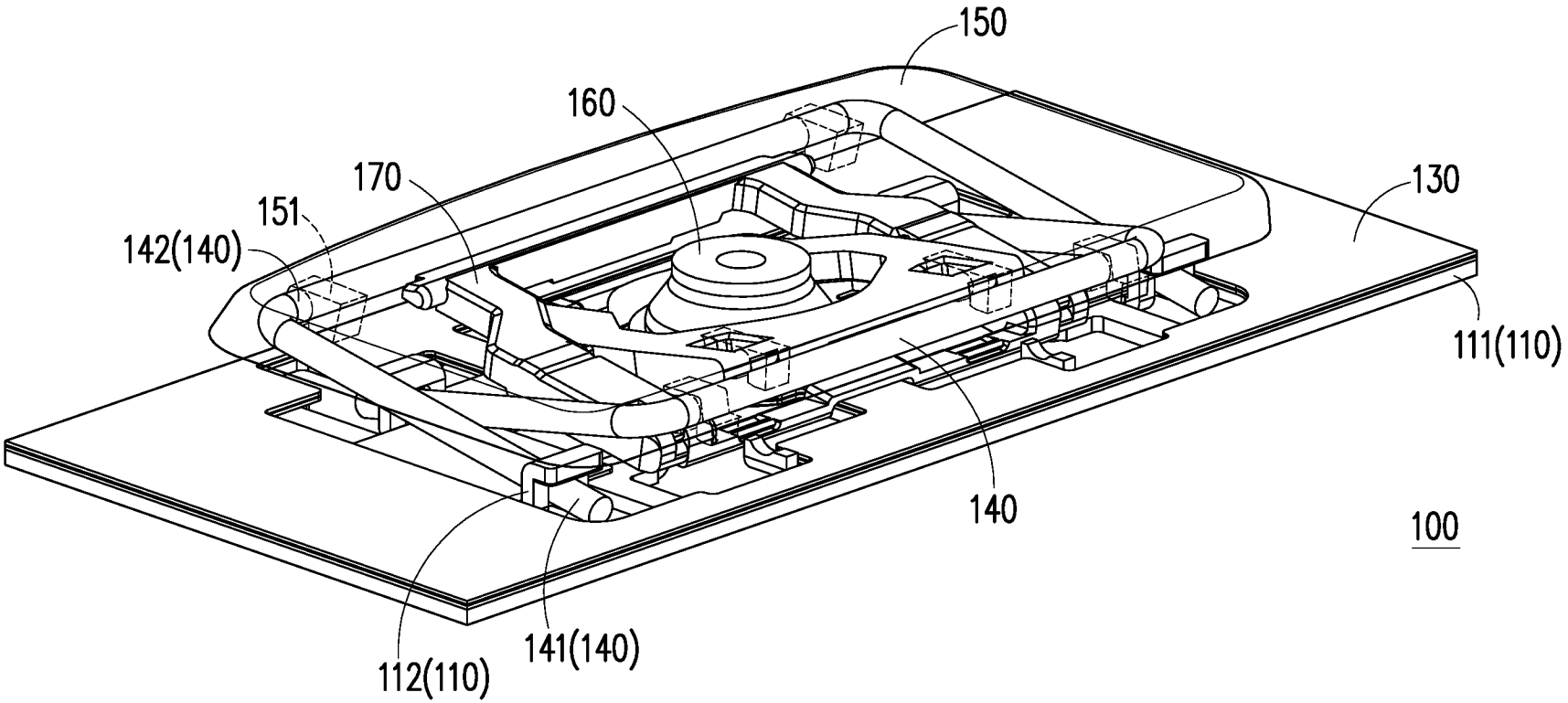
FIG. 1 is a schematic diagram of a key structure according to an embodiment of the disclosure.
Figure 2:
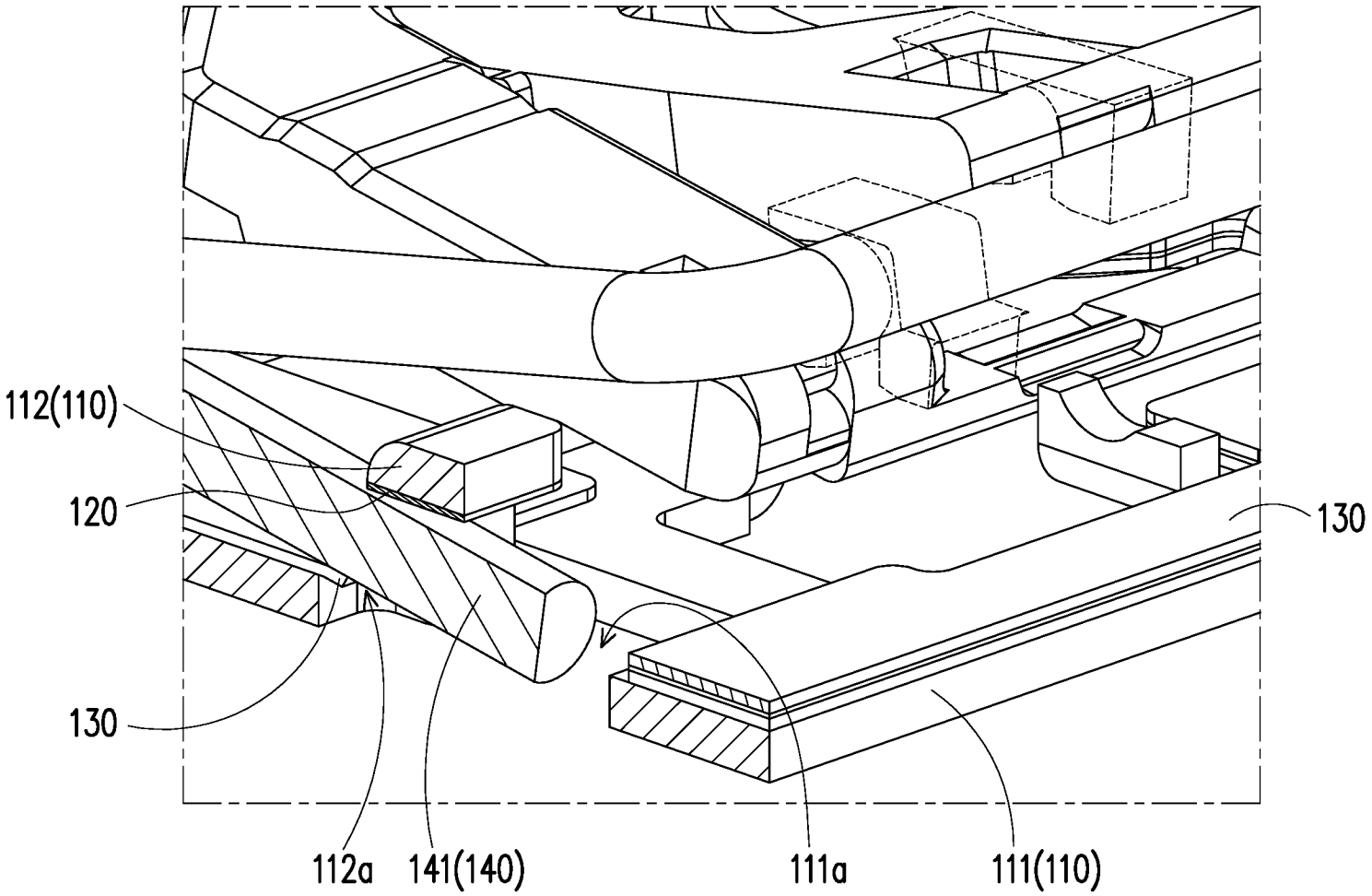
FIG. 2 is a schematic diagram of a partially enlarged cross-sectional view of a key structure according to an embodiment of the disclosure.
Figure 3:
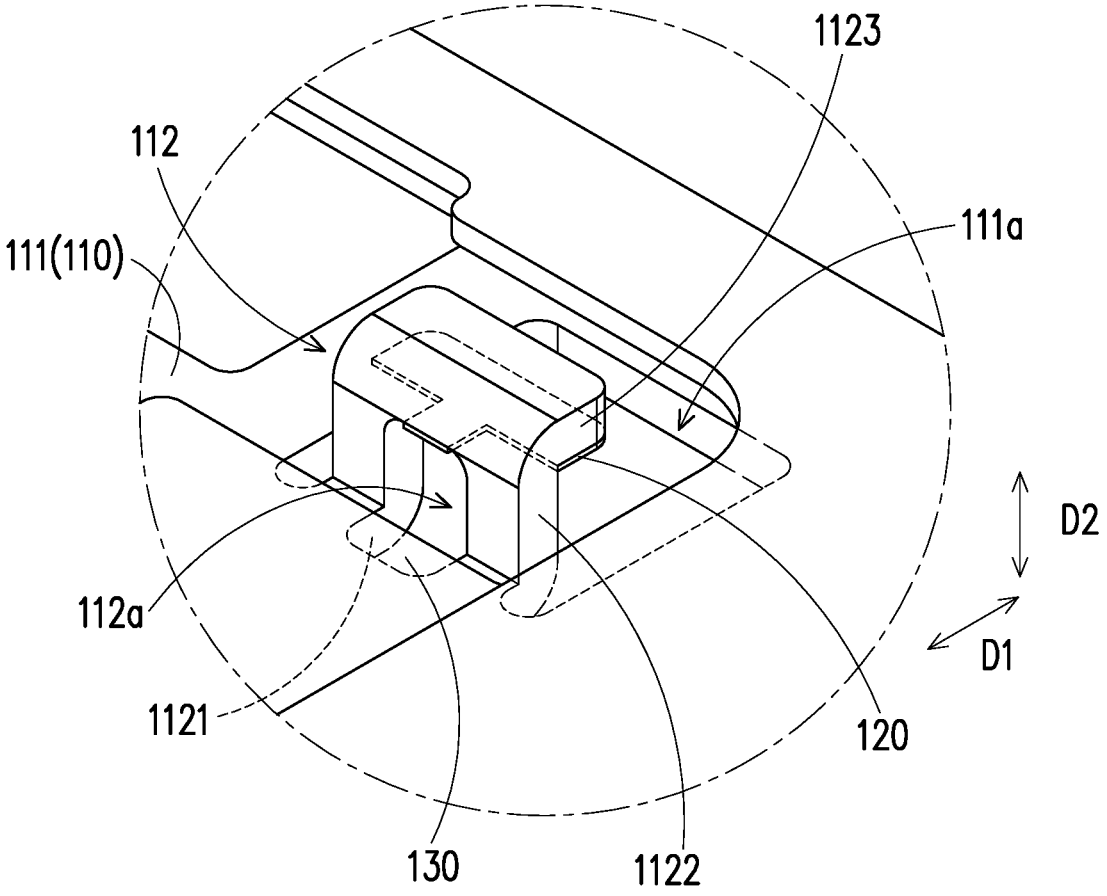
FIG. 3 is a partially enlarged schematic diagram of a carrier and a circuit film of a key structure according to an embodiment of the disclosure.

FIG. 1 is a schematic diagram of a key structure according to an embodiment of the disclosure. FIG. 2 is a schematic diagram of a partially enlarged cross-sectional view of a key structure according to an embodiment of the disclosure. FIG. 3 is a partially enlarged schematic diagram of a carrier and a circuit film of a key structure according to an embodiment of the disclosure. In order to clearly show the internal configuration of a key structure 100, a key cap 150 in the figures is presented in a perspective mode, and FIG. 2 omits illustrating the key cap 150. Referring to FIG. 1 to FIG. 3, in the embodiment, the key structure 100 is a part of a keyboard, and the key structure 100 includes a carrier 110, buffer layers 120, a circuit film 130, balance rods 140 and the key cap 150, where the circuit film 130 covers the carrier 110 and exposes a partial block of the carrier 110, such as a hole or a part for matching with each balance rod 140.

Further, the carrier 110 includes a body 111 and positioning elements 112, where the body 111 is provided with through holes 111*a*, the circuit film 130 covers the body 111, and the through holes 111*a* and the positioning elements 112 are exposed outside the circuit film 130. The positioning elements 112 protrude from the body 111 and are seated in the through holes 111*a*. The positioning elements 112 are matched with the balance rods 140, and the number of the positioning elements 112 depends on the number of the balance rods 140. For example, a balance rod 140 usually needs to be matched with two parallel positioning elements 112 to improve the stability during actuation relative to the carrier 110.

The balance rods 140 are movably disposed on the body 111, and each balance rod 140 has an opposite first end portion 141 and a second end portion 142. In the embodiment, the number of the balance rods 140 is two, and the balance rods 140 are staggered with each other and are generally X-shaped. The number of the first end portions 141 of each balance rod 140 is two, and the first end portions 141 respectively pass through positioning holes 112*a* of two corresponding positioning elements 112. The key cap 150 is disposed above the body 111 and is connected with the body 111 through two balance rods 140. Further, the second end portion 142 of each balance rod 140 is connected with a side of the key cap 150 facing the body 111, and the circuit film 130 and the two balance rods 140 are positioned between the key cap 150 and the body 111.

Because the second end portion 142 of each balance rod 140 is rotationally connected to the key cap 150 and the two first end portions 141 are movably pass through the positioning holes 112*a* of the two corresponding positioning elements 112 respectively, the key cap 150 may be stably moved closer to or away from the carrier 110 through the two staggered balance rods 140. In the embodiment, the buffer layer 120 is disposed around each positioning hole 112*a*, and each first end portion 141 presses against the corresponding positioning element 112 through the corresponding buffer layer 120, so that in a process that each first end portion 141 slides relative to the corresponding positioning element 112, based on the obstruction of the buffer layer 120, friction and collision between each balance rod 140 and the two corresponding positioning elements 112 cannot be generated, noise generated during actuation of the key structure 100 may be greatly reduced, and the discomfort of a user in the process of operating the keyboard may be avoided. For example, the buffer layer 120 may be made of polyurethane, epoxy resin or other suitable materials and is not limited by the disclosure. On the other hand, the circuit film 130 is partially seated in the positioning hole 112*a* of each positioning element 112, and a side of each first end portion 141 facing the body 111 presses against the circuit film 130 in the corresponding positioning hole 112*a*, so that in the process that each first end portion 141 slides relative to the body 111, based on the obstruction of the circuit film 130, friction and collision between each balance rod 140 and the body 111 cannot be generated, and noise generated during actuation of the key structure 100 may be greatly reduced. In addition, under the condition that friction and collision between each balance rod 140 and the positioning elements 112 and the body 111 are greatly reduced, resonance of other elements of the keyboard due to vibration during actuation of the key structure 100 may be favorably avoided.

Figure 7:
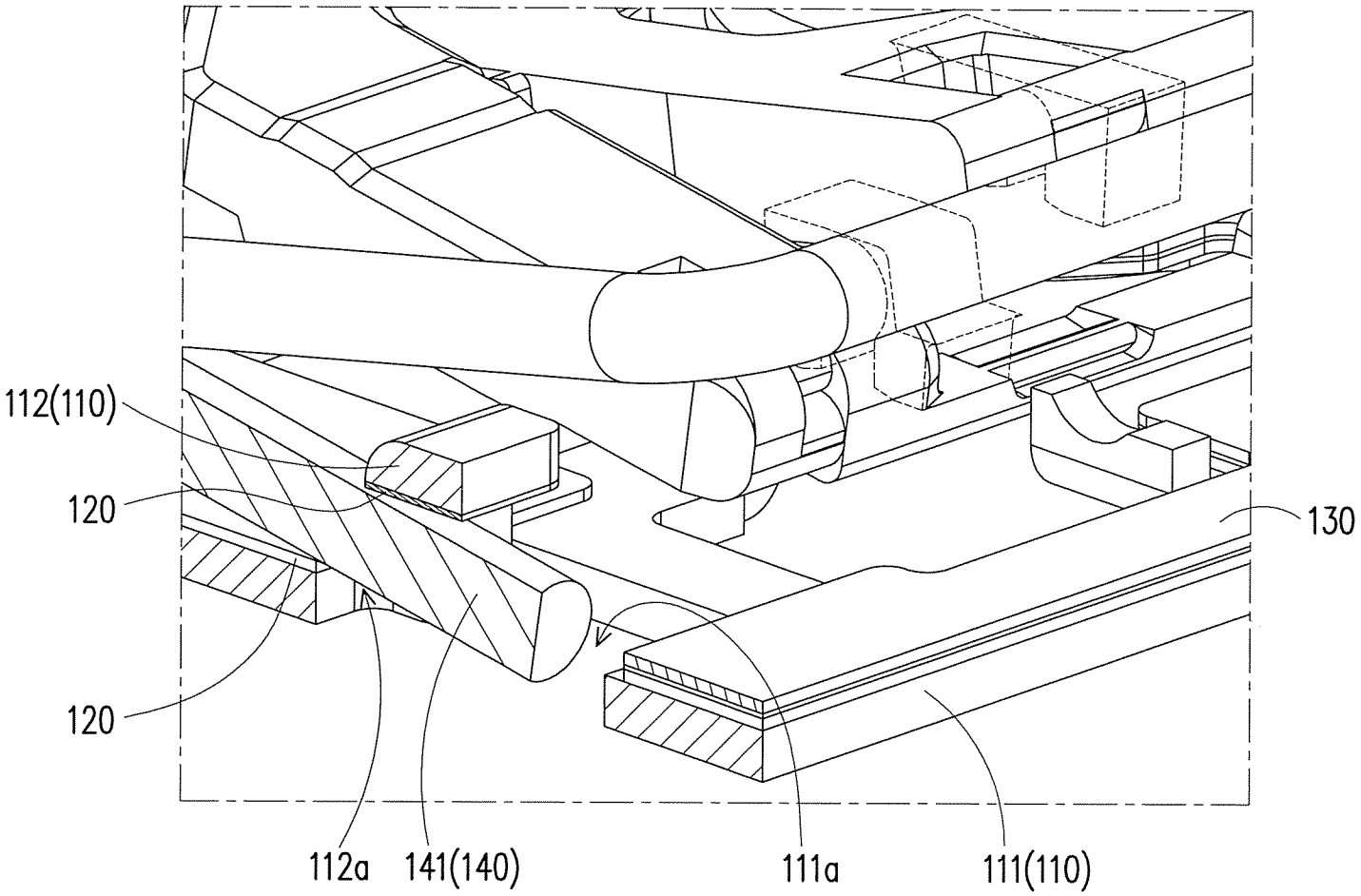
FIG. 7 is a schematic diagram of a partially enlarged cross-sectional view of a key structure according to still another embodiment of the disclosure.

According to the structural design of any one positioning element 112, the positioning element 112 includes a connecting portion 1121, a first extension portion 1122 and a second extension portion 1123, where the connecting portion 1121 is connected with an inner wall surface of the through hole 111*a* and extends along a first direction D1 in the through hole 111*a*. The second extension portion 1123 is positioned above the through hole 111*a*, the second extension portion 1123 is parallel to the connecting portion 1121, and an orthographic projection of the second extension portion 1123 is in the through hole 111*a*. The extending direction of the second extension portion 1123 is substantially parallel to the first direction D1, and the second extension portion 1123 is connected with the connecting portion 1121 through the first extension portion 1122. For example, the first extension portion 1122 extends along a second direction D2 from the connecting portion 1121 to the second extension portion 1123, and the first direction D1 and the second direction D2 are substantially perpendicular to each other. On the other hand, the positioning hole 112*a* at least runs through the connecting portion 1121 and the first extension portion 1122 to improve the convenience of assembling the balance rod 140 and the smoothness during actuation of the balance rod 140. For example, the buffer layer 120 is disposed at a side of the second extension portion 1123 facing the body 111 and may further extend into the positioning hole 112*a*. In particular, the arrangement of the buffer layer 120 is not limited to the above and may be adjusted according to requirements. For example, the buffer layer 120 is disposed at all or part of the inner wall surface of the positioning hole 112*a*, or a block in which the carrier 110 may be in contact with the balance rod 140, as shown in FIG. 7.

Referring to FIG. 1, in the embodiment, a side of the key cap 150 facing the body 111 is provided with a pivotal connection portion 151, and the second end portion 142 of the balance rod 140 may pass through the pivotal connection portion 151 to rotate relative to the key cap 150. In another direction, the key structure 100 further includes a dome switch 160 and a reciprocating element 170, where the dome switch 160 is positioned between the key cap 150 and the circuit film 130, and two opposite ends of the dome switch 160 are respectively connected with the key cap 150 and the circuit film 130. The dome switch 160 is driven by the key cap 150 to generate elastic deformation so as to conduct a circuit of the circuit film 130. On the other hand, the reciprocating element 170 may be of a scissor foot structure and is positioned between the key cap 150 and the body 111, and two opposite ends of the reciprocating element 170 are respectively connected with the key cap 150 and the body 111 to guide the key cap 150 to stably move closer to or away from the body 111.

Other embodiments will be described below, the same or similar structural design and actuation modes may refer to the description of the aforementioned embodiments, and the detailed description is not repeated.

Figure 4:
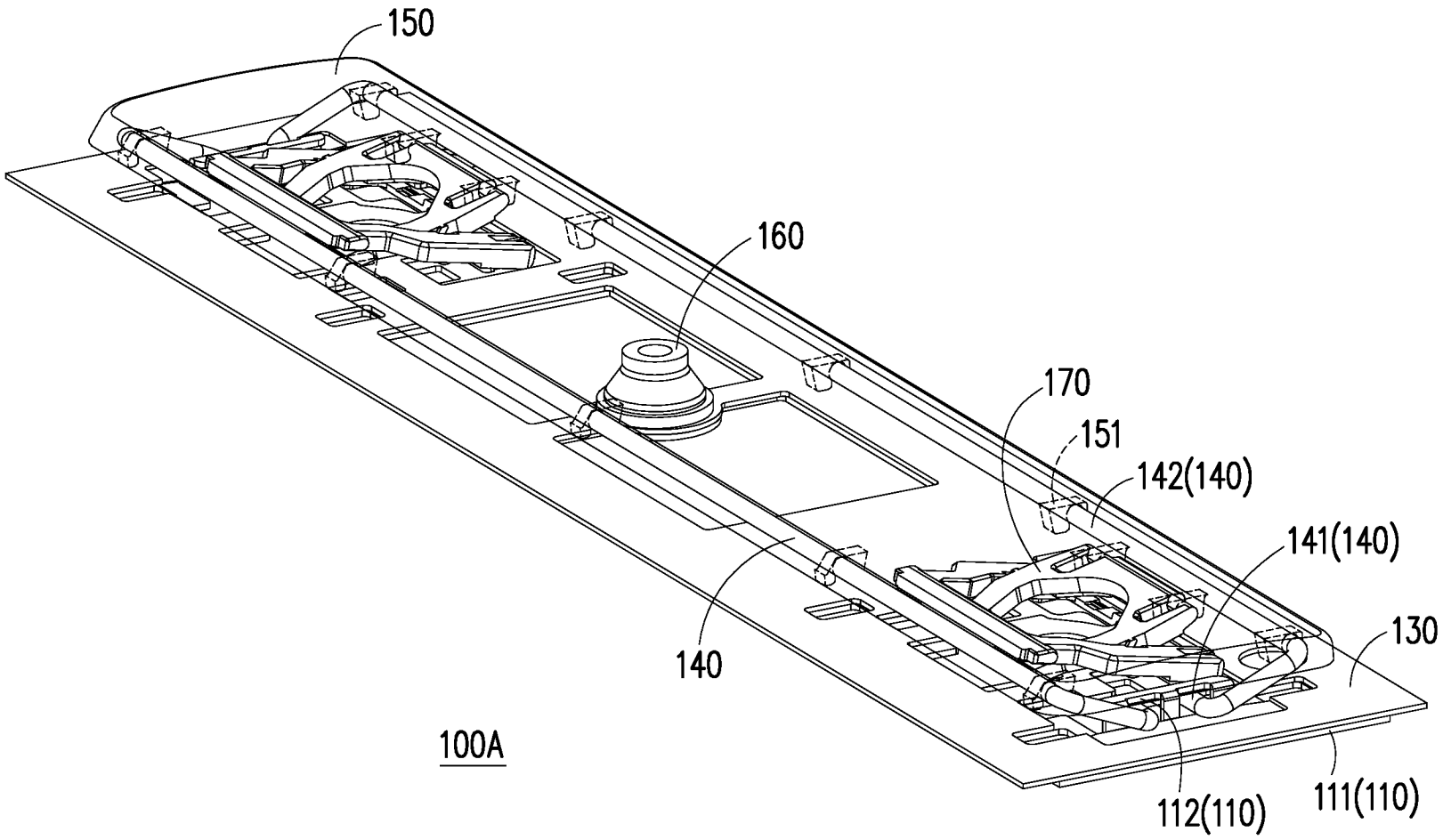
FIG. 4 is a schematic diagram of a key structure according to another embodiment of the disclosure.
Figure 5:
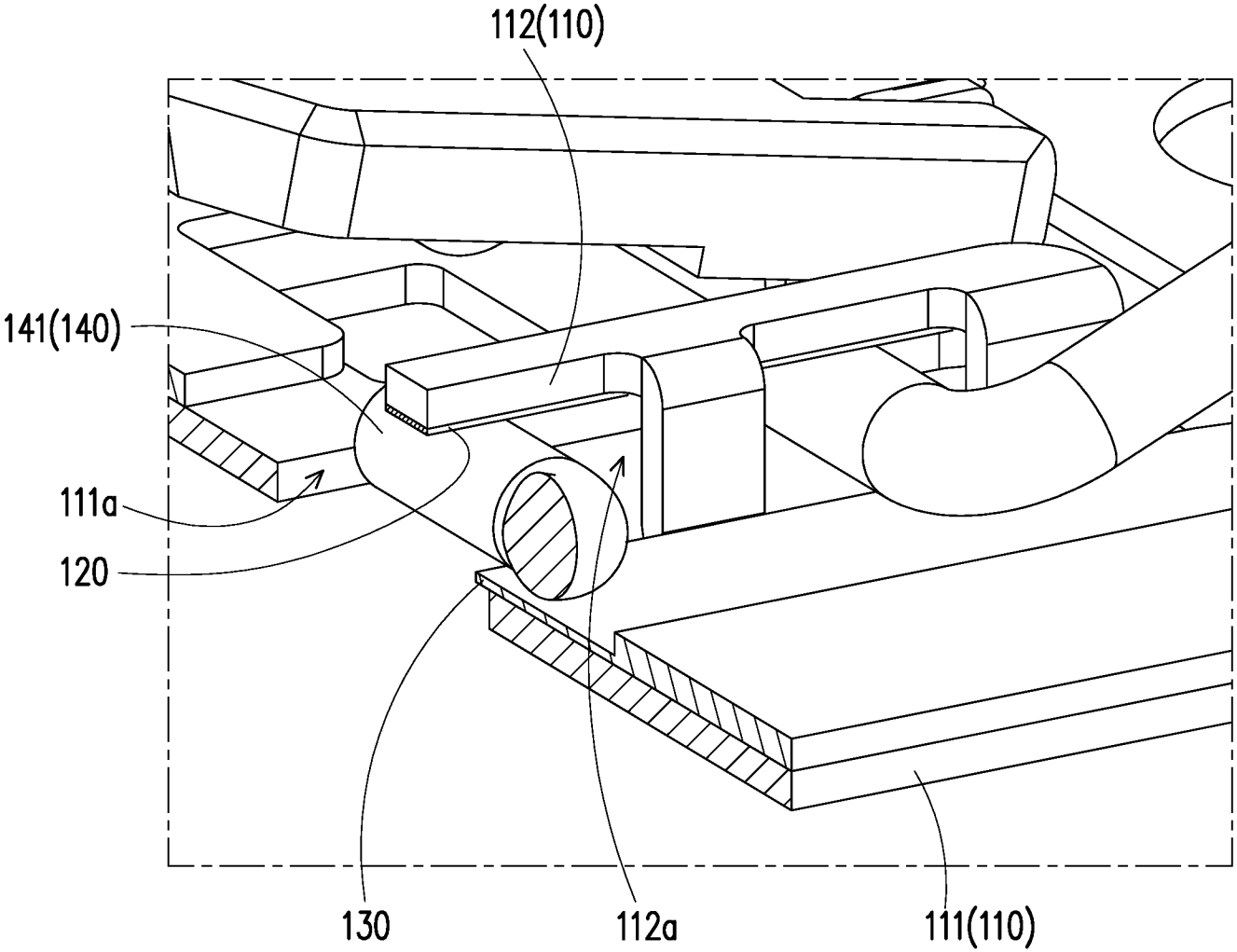
FIG. 5 is a schematic diagram of a partially enlarged cross-section view of a key structure according to another embodiment of the disclosure.
Figure 6:
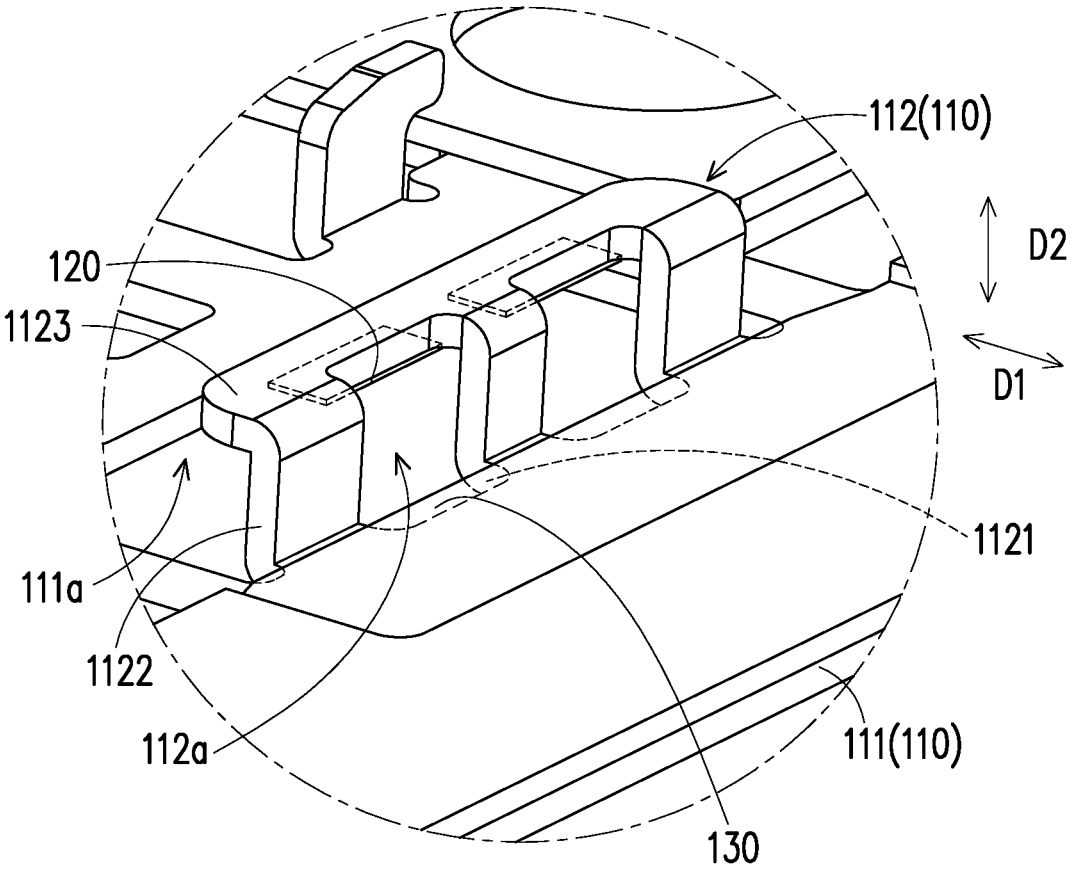
FIG. 6 is a partially enlarged schematic diagram of a carrier and a circuit film of a key structure according to another embodiment of the disclosure.

FIG. 4 is a schematic diagram of a key structure according to another embodiment of the disclosure. FIG. 5 is a schematic diagram of a partially enlarged cross-sectional view of a key structure according to another embodiment of the disclosure. FIG. 6 is a partially enlarged schematic diagram of a carrier and a circuit film of a key structure according to another embodiment of the disclosure. In order to clearly show the internal configuration of a key structure 100A, a key cap 150 in the figures is presented in a perspective mode, and FIG. 5 omits illustrating the key cap 150. Referring to FIG. 4 to FIG. 6, the main difference between the key structure 100A of the embodiment and the key structure of the previous embodiment is a configuration method of balance rods 140. In the embodiment, the two balance rods 140 are disposed in parallel and are generally V-shaped. Two first end portions 141 of each balance rod 140 are respectively pivoted with two positioning holes 112*a*, so that the balance rod 140 may rotate relative to the body 111. During actuation of the key structure 100, a rotating direction of one of the two balance rods 140 is opposite to the rotating direction of the other one of the two balance rods 140.

In summary, the buffer layer is disposed in the arrangement position of each balance rod in the carrier of the key structure of the disclosure, or the circuit film is used for obstruction of each balance rod and the carrier, so that during actuation of the balance rod relative to the carrier, based on the obstruction of the buffer layer or the circuit film, friction and collision between the balance rod and the carrier cannot be generated, thus noise generated during actuation of the key structure may be greatly reduced, and the discomfort of the user in the process of operating the keyboard may be avoided. In addition, under the condition that friction and collision between the balance rods and the positioning elements and the body are greatly reduced, resonance generated by other elements of the keyboard due to vibration during actuation of the key structure may be favorably avoided.

Finally, it should be noted that the above embodiments are only used to illustrate but not limit the technical solutions of the disclosure; although the disclosure has been described in detail with reference to the aforementioned embodiments, those of ordinary skill in the art should understand that: the technical solutions described in the aforementioned embodiments may be modified, or some or all technical features may be equivalently replaced; and through these modifications and replacements, the corresponding technical solutions substantially do not depart from the scope of the technical solutions of the embodiments of the disclosure.

What is claimed is:

1. A key structure, comprising:

a carrier, comprising a body having a through hole and a positioning element protruding from the body, wherein the positioning element has a positioning hole, a first side facing the through hole and a second side opposite to the first side;

a buffer layer, disposed around the positioning hole, wherein the buffer layer is not disposed on the second side which is parallel to the body, the buffer layer extends to the first side and a portion of the first side is not covered by the buffer layer;

a circuit film, disposed on the body;

a balance rod, disposed on the body, wherein the balance rod has opposite a first end portion and a second end portion, and the first end portion passes through the positioning hole and presses against the buffer layer; and a key cap, connected with the second end portion, wherein the circuit film and the balance rod are positioned between the key cap and the body.

2. The key structure according to claim 1, wherein the positioning element is seated in the through hole.

3. The key structure according to claim 2, wherein the positioning element comprises a connecting portion, a first extension portion and a second extension portion, the connecting portion is connected with an inner wall surface of the through hole, the second extension portion is positioned above the through hole and is parallel to the connecting portion, wherein the second extension portion is connected with the connecting portion through the first extension portion, and the positioning hole runs through the connecting portion and the first extension portion.

4. The key structure according to claim 3, wherein the buffer layer is disposed at a side of the second extension portion facing the through hole.

5. The key structure according to claim 4, wherein the buffer layer partially extends into the positioning hole.

6. The key structure according to claim 1, wherein the circuit film is partially located in the positioning hole and presses against the first end portion.

7. The key structure according to claim 1, wherein a side of the key cap facing the body is provided with a pivotal connection portion, and the second end portion passes through the pivotal connection portion.

8. The key structure according to claim 1, further comprising:

a reciprocating element, positioned between the key cap and the body, wherein two opposite ends of the reciprocating element are respectively connected with the key cap and the body.

9. The key structure according to claim 1, further comprising:

a dome switch, positioned between the key cap and the circuit film, wherein two opposite ends of the dome switch are respectively connected with the key cap and the circuit film.

10. A key structure, comprising:

a carrier, comprising a body having a through hole and a positioning element protruding from the body, wherein the positioning element has a positioning hole, a first side facing the through hole and a second side opposite to the first side;

a buffer layer, disposed on the first side which is parallel to the body, wherein a portion of the first side is not covered by the buffer layer;

a circuit film, disposed on the body;

a balance rod, disposed on the body, wherein the balance rod has opposite a first end portion and a second end portion, and the first end portion passes through the positioning hole and presses against the buffer layer; and a key cap, connected with the second end portion, wherein the circuit film and the balance rod are positioned between the key cap and the body.

11. A key structure, comprising:

a carrier, comprising a body having a through hole and a positioning element protruding from the body, wherein the positioning element has a positioning hole;

a balance rod, disposed on the body, wherein the balance rod has opposite a first end portion and a second end portion, and the first end portion passes through the positioning hole;

a buffer layer, wherein the first end portion presses against the buffer layer;

a circuit film, disposed on the body; and a key cap, connected with the second end portion, wherein the circuit film and the balance rod are positioned between the key cap and the body, wherein the positioning element comprises a first extension portion extending from the body toward the key cap and a second extension portion connected to the first extension portion, and the second extension portion extends along a direction parallel to the body, the second extension portion has a first side facing the through hole and a second side facing the key cap, wherein the buffer layer is disposed on the first side and a portion of the first side is not covered by the buffer layer.

* * * * *